United States Patent [19]

Clark

[11] 4,064,036

[45] Dec. 20, 1977

[54] PRESSURE TESTING OF CATALYST LOADED REACTORS

[75] Inventor: Danford E. Clark, Fountain Valley, Calif.

[73] Assignee: Union Oil Company of California, Los Angeles, Calif.

[21] Appl. No.: 732,533

[22] Filed: Oct. 14, 1976

Related U.S. Application Data

[63] Continuation-in-part of Ser. No. 614,174, Sept. 17, 1975, abandoned.

[51] Int. Cl.[2] ..... B01J 29/14; G01M 3/04; G01N 31/10; G01N 33/00

[52] U.S. Cl. ..... 208/46; 73/49.2; 73/49.3; 208/140; 208/111; 252/455 Z; 23/230 L

[58] Field of Search ..... 23/230L; 73/49.2, 49.3, 73/40; 208/111, 140, 46 R; 252/455 Z

[56] References Cited

U.S. PATENT DOCUMENTS

| | | | |
|---|---|---|---|
| 3,201,356 | 8/1965 | Kress et al. | 252/455 Z |
| 3,213,013 | 10/1965 | Arey, Jr. et al. | 252/455 Z |
| 3,800,586 | 4/1974 | Delatorre | 73/49.2 |
| 3,921,436 | 11/1975 | Plegat | 73/49.2 |

FOREIGN PATENT DOCUMENTS

| | | | |
|---|---|---|---|
| 675,425 | 12/1963 | Canada | 73/49.2 |

*Primary Examiner*—Joseph Scovronek
*Assistant Examiner*—Michael S. Marcus
*Attorney, Agent, or Firm*—Lannas S. Henderson; Richard C. Hartman; Dean Sandford

[57] ABSTRACT

In the pressure testing of catalyst-loaded reactors with nitrogen gas at elevated temperatures, it is found that certain types of zeolite catalysts are substantially degraded in activity. The catalysts concerned comprises a Group VIII noble metal in an oxidized state, dispersed on a crystalline hydrogen zeolite, e.g., Y zeolite. It has now been discovered however that if such catalysts are first prereduced with a dilute, non-combustible mixture of nitrogen and hydrogen, damage on subsequent pressure testing with nitrogen is prevented or drastically reduced. Following pressure testing, the catalyst is activated by dehydration in a stream of hydrogen at elevated temperatures and pressures.

9 Claims, No Drawings

PRESSURE TESTING OF CATALYST LOADED REACTORS

RELATED APPLICATIONS

This application is a continuation-in-part of Serial No. 614,174, filed Sept. 17, 1975, and now abandoned.

BACKGROUND AND SUMMARY OF INVENTION

In the commercial startup of processes utilizing high-pressure hydrogen, e.g. hydrocracking, it is common practice to carry out a preliminary pressure test of the catalyst-loaded reactor in order to insure against possible leakage of combustible gases during subsequent processing. Commonly, for safety reasons an inert gas is employed for this pressure testing, nitrogen being preferred for economy reasons. For most operations nitrogen performs very satisfactorily, but for reasons which are still largely conjectural, at elevated temperatures (above 200° F) nitrogen has been found to have a substantial adverse effect upon certain catalysts comprising a Group VIII noble metal supported on crystalline aluminosilicate zeolites, wherein the zeolite support has been substantially converted to a hydrogen and/or dehydroxylated form. In some cases, it has been found that after undergoing nitrogen pressure testing, the activity of such catalysts for hydrocracking and/or hydrogenation is drastically reduced, to levels of only a small fraction of the initial fresh activity. Surprisingly, seemingly analogous catalysts based on metal-stabilized crystalline zeolites, such as magnesium-stabilized zeolites, do not appear to be affected adversely by high-temperature nitrogen. Another puzzling aspect of the invention is that the damage appears to occur only when the catalyst is in an oxidized state; in the reduced state, little or no damage occurs.

In view of the foregoing, it would appear that the above noted damage could be avoided by either of two possible expedients. Firstly, since the nitrogen damage becomes significant only at temperatures above about 200° F, pressure testing could be carried out at temperatures sufficiently low to avoid significant damage. However, this alternative would be hazardous in many cases due to the "hydrogen-embrittlement" which many catalytic reactors composed of ferrous alloys may have previously undergone through extended use at high hydrogen pressures. When such embrittlement occurs, the "transition temperature" of the reactor walls may substantially incrase, to levels in the range of about 200°-300° F. The transition temperature is the temperature below which cracks in the reactor walls will propagate (at a given operating pressure) in an instantaneous, catastrophic manner, and above which cracks will be arrested by the inherent toughness of the metal. It is hence considered a prudent safety measure to conduct pressure testing (at pressures in excess of about 700 psig) only at temperatures above about 200° F, and preferably above about 300° F.

In view of the foregoing hazards, and in view of my discovery that high temperature nitrogen has a much less adverse effect upon the catalyst when in a reduced state, the present invention is directed to the feature of prereducing the catalyst with a noncombustible mixture of nitrogen and hydrogen prior to the high temperature pressure testing. Catalysts of the present description are ordinarily loaded into reactors in a calcined, oxidized state, and later activated by reduction and dehydration with high-pressure, high-temperature hydrogen following the pressure testing. I have now found that it is perfectly feasible to reduce the catalyst with dilute hydrogen at relatively low pressures and temperatures prior to pressure testing, thereby avoiding to a major extent the above noted nitrogen damage during pressure testing, and then complete the activation-dehydration as an integral part of the normal process startup procedure. The prereduction is carried out using a mixture of nitrogen and hydrogen in which the hydrogen concentration is below that required to give a combustible mixture, i.e., below about 6 volume percent. This procedure permits prereduction to be carried out safely without danger of fires or explosions in the event of leakage from the reactor. If desired, the same dilute nitrogen-hydrogen mixtures may be utilized for the subsequent pressure testing.

DETAILED DESCRIPTION

The present invention is especially contemplated for use in connection with catalysts comprising a crystalline, hydrothermally stabilized, low-sodium, metal-cation-deficient zeolite base (preferably Y zeolite) upon which is deposited a minor proportion, e.g., about 0.1-2 weight-percent, of a Group VIII noble metal hydrogenating component, preferably palladium and/or platinum. The term "metal-cation-deficient" refers to hydrogen and/or dehydroxylated zeolites in which less than 25%, preferably less than about 10% of the original zeolitic ion exchange capacity is satisfied by metal cations. The term "hydrothermally stabilized" means a metal cation deficient zeolite which has been thermally or hydrothermally pretreated to achieve structural stability against the effects of steam at high temperatures. Another characteristic of the zeolites utilized herein is their low sodium content, which is less than 3 weight-percent, and usually less than about 1%, as $Na_2O$. A particularly preferred class of catalysts to which the present invention may be usefully applied is described in U.S. Pat. No. 3,897,327. Other stabilized hydrogen Y zeolite catalyst bases are described in U.S. Pat. Nos. 3,449,070, 3,403,519, 3,293,192 and 3,354,077.

In nearly all cases, the final step in manufacture of the foregoing catalysts consists of a calcination in air at temperatures of about 700°-1200° F, to effect final dehydration, decomposition of any remaining zeolitic ammonium ions, and conversion of the noble metal component to an oxide form. According to the present invention, after loading the calcined catalyst into the reactor in which it is to be utilized, and prior to pressure testing, the catalyst is prereduced with a hydrogen-containing gas at relatively low pressures to convert the oxidized noble metal substantially to the free metal. The reducing gas mixture comprises about 0.02-6, preferably about 0.1-5 volume percent of hydrogen, the remainder being nitrogen. Mixtures of nitrogen and hydrogen comprising less than about 6 volume percent hydrogen are essentially non-combustible, and hence can be safely used for prereducing even if some leakage occurs from the reactor. The reduction can be carried out successfully either with a once-through flow of reducing gas, or with recycle of unreacted gas to which makeup hydrogen is added. Practical operating pressures range between about 0 and 700 psig, preferably (in the case of recycle operations) between about 200-500 psig.

The time required to complete the prereduction depends of course upon several factors, mainly the noble metal content of the catalyst, the reduction gas flow rate, its hydrogen concentration, and the temperature. Since no more than the stoichiometric amount of hydrogen is theoretically required to complete the reduction, as e.g.,:

$$PdO + H_2 \rightarrow Pd + H_2O,$$

completion of the reduction can be detected simply by monitoring hydrogen consumption. Other factors being equal, the reduction proceeds more rapidly at elevated temperatures, but nevertheless proceeds at a substantial rate even at room temperature. Operative reduction temperatures range between about 50° and 700° F, preferably between about 100° and 500° F.

It is preferred that at least the initial portion, e.g., 50%, of the reduction be carried out at temperatures below about 200° F, and further that temperatures in excess of 400° F not be reached until after at least about 90% of the reduction is completed. By observing these temperature limitations, maximum reduction of the catalyst takes place at temperatures below those at which the adverse effect of nitrogen becomes a significant factor.

It is not essential however, that the reduction be carried to 100% completion. Any significant degree of reduction of the noble metal oxide will give some useful degree of improved resistance to nitrogen-deactivation. A significant reduction of noble metal oxide to the free metal can be detected by visual observance of color change of the catalyst. In its oxidized form, the catalyst is light buff or pink in color, and changes to grey upon reduction with hydrogen.

The prereduction procedures described above could be extended in time and severity so as to complete the entire activation of the catalyst, which entails in addition to chemical reduction, a substantially complete dehydration. (Through contact with air in shipping and loading into the reactor, the catalyst generally contains from about 2–20 weight percent of strongly absorbed water, which is difficult to remove.) However, this dehydration requires a large heat input, and since hydrogen is a more efficient heat carrier than nitrogen, it is much more economical and time-saving to terminate the reduction before complete dehydration takes place, and postpone the final dehydration until after the pressure test, so that high-pressure hydrogen can then be used for final activation and startup. The circulation of high-pressure hydrogen through the system is required in any event, prior to introduction of the feedstock.

Following prereduction, the catalyst is then subjected to pressure testing by pressuring the reactor with nitrogen, or non-combustible mixtures of nitrogen and hydrogen, under no-flow conditions to a pressure preferably about 200–300 psig higher than the contemplated process operating pressure. At pressure test conditions between about 1200 and 2500 psig, it is preferred to maintain temperatures above about 300° F, preferably about 400°–500° F. The test pressure is normally maintained for about 1–5 hours, and if no significant pressure drop is noted, the reactor system is deemed to be leak-free.

Upon completion of pressure testing, the reactor is depressured and process hydrogen flow is established, with incremental heatup over a period of several hours to achieve process temperatures. Final activation of the catalyst also takes place during the heatup period, after which the desired process feedstock is introduced into the flowing, preheated hydrogen stream.

The final activation (dehydration) is most efficiently carried out at pressures above about 800 psig, using a substantially dry, hydrogen-rich gas containing at least about 50 volume percent hydrogen. Gas flow rates of at least about 100 GHSV are preferred, with inlet temperatures gradually increasing over a period of at least about 3 hours to a maximum of at least about 450° F, preferably about 650° F. In most cases the activation will require at least about 24 hours. The dew point of effluent activation gases should preferably be maintained below about 0° F at all bed temperatures above about 400° F.

Utilizing as the catalyst a calcined composite of 0.5 weight percent palladium supported on a steam stabilized hydrogen Y zeolite of the type described in U.S. Pat. No. 3,897,327, a preferred exemplary sequence of prereducing, pressure testing and activation is as follows:

1. purge reactor system with nitrogen at ambient temperatures and pressures to remove air.
2. pressure unit to 200 psig with a reducing gas consisting of 2 volume percent hydrogen and 98 volume percent nitrogen and establish a gas flow rate of about 2200 SCF per hour per cubic foot of catalyst.
3. heat up unit from ambient to 400° F at 25° F/hr.
4. hold reactor at 400° F for 4–5 hours.
5. pressure unit to 1800 psig with 98 percent nitrogen-2 percent hydrogen mixture under static flow conditions and hold at 400° F for 2 hours while monitoring for pressure drop.
6. depressure unit, then repressure to 1450 psig with hydrogen and establish a gas flow rate of about 2200 SCF per hour per cubic foot of catalyst.
7. heat up catalyst to desired hydrocracking temperature at rate of about 50° F/hr.
8. introduce desired hydrocracking feedstock into reactor.

To substantiate the critical features of the invention, the following non-limiting examples are cited:

EXAMPLE 1

A 150 ml sample of a calcined composite of 0.5 wt.% Pd supported on a 20% $Al_2O_3$ −80% steam-stabilized hydrogen Y zeolite base (0.2 wt. % $Na_2O$) of the type described in U.S. Pat. No. 3,897,327 was loaded into a reactor for activity testing. Prior to the activity test, the reactor was pressure-tested at 1500 psig with nitrogen at room temperature. After activating the catalyst as described in steps (6), (7) and (8) above, a standard hydrocracking activity test was carried out at 1450 psig, 1.7 LHSV and 8000 SCF/B of hydrogen, using as the feed a substantially nitrogen-free 400°–850° F boiling range gas oil containing 0.5 wt. % sulfur. Activity was measured in terms of the temperature required to maintain 52–54 volume-percent conversion per pass to 420° F endpoint gasoline after 100 hours on stream. This temperature was found to be 496° F, which is essentially the fresh activity of the catalyst as determined without a prior pressure test. Thus, nitrogen at room temperature has no significant adverse effect on the catalyst.

EXAMPLES 2–4

Three additional 150 ml samples of the catalyst employed in Example 1 were subjected to the same hydrocracking activity test, after having encountered nitrogen at elevated temperatures during a pressure testing sequence in which the reactor and catalyst were:

1. Pressured to 200 psig with nitrogen flowing at 12 cf/hr.;
2. Heated to the desired pressure-test temperature (200°, 300° and 400° F) at the rate of 25° F/hr.;
3. Held at 200 psig in flowing nitrogen for a total of 16 hours, including heatup time; and
4. Pressured to 1800 psig with nitrogen under noflow conditions and held for 2 hours at the desired pressure test temperature (200°, 300° and 400° F).

Activating and testing the respective catalysts as in Example 1 gave the following results:

TABLE 1

| Example | Pressure Test Temp., ° F | Temp. Required for 52-54% Conversion, ° F | Loss in Activity, ° F |
|---|---|---|---|
| 1 | ~70 | 496 | — |
| 2 | 200 | 511 | 15 |
| 3 | 300 | 537 | 41 |
| 4 | 400 | 616 | 120 |

The significance of the above losses in activity can be appreciated from the fact that each 20° F loss corresponds to a kinetic activity loss of about one-half. Thus, the 120° F loss in Example 4 means that the catalyst is only about 1/64 as active as the catalyst from Example 1, on the basis of volume of catalyst required to maintain the same conversion at the same temperature.

EXAMPLE 5

The 400° F pressure test of Example 4 was repeated, except that in steps (1), (2) and (3), the nitrogen gas contained about 4.5 vol. % of hydrogen. After the pressure test in nitrogen at 1800 psig and 400° F, the catalyst was activity tested as in Example 1, and found to require a temperature of only 510° F to give 52-54% conversion. Thus, as a result of prereducing, the 120° F activity loss of Example 4 was reduced to only 14° F.

EXAMPLE 6

The 400° F pressure test of Example 4 was repeated, except that in steps (1), (2), (3) and (4), the nitrogen gas contained about 0.3 vol. % of hydrogen. In the standard activity test the resulting catalyst was found to give 52-54% conversion at 515° F. Thus, the activity loss of Example 4 was reduced from 120° F to 19° F.

EXAMPLE 7

The 200° F pressure test of Example 2 was repeated, except that in steps (1), (2), (3) and (4) the nitrogen gas contained about 4.5 vol. % of hydrogen. In the standard activity test, the resulting catalyst was found to give 52-54% conversion at 504° F. Thus, the activity loss of Example 2 was reduced from 15° F to 8° F as a result of prereducing the catalyst.

The following claims and their obvious equivalents are believed to define the true scope of the invention.

I claim:

1. In the startup of a hydrocarbon conversion process employing high-pressure hydrogen, wherein said process is carried out in a pressure-retaining system including a ferrous reactor initially charged with a catalyst comprising a Group VIII noble metal in an oxidized state supported on an at least partially hydrated crystalline aluminosilicate zeolite, the improved method for pressure-testing said system and activating said catalyst which comprises:

1. reducing said catalyst in said reactor by contacting the same with a sufficient amount of a non-combustible reducing gas comprising a mixture of nitrogen and hydrogen to provide at least one mole of hydrogen per mole of noble metal in said catalyst, at least the initial portion of said contacting being carried out at between about 50° and 300° F, said contacting being terminated prior to complete dehydration of said catalyst;
2. pressuring said system and catalyst with a non-combustible gas made up primarily of nitrogen to a static pressure above about 700 psig and above the contemplated operating pressure of said conversion process, and maintaining said static pressure at a temperature above about 200° F for a sufficient time to detect gas leakage from the system; and then
3. contacting said catalyst with a stream of substantially dry hydrogen-rich gas containing at least about 50 volume-percent hydrogen at a pressure above about 800 psig, a flow rate of at least about 100 GHSV and at temperatures gradually increasing to a maximum of at least about 450° F over a period of at least about 3 hours, thereby substantially dehydrating and activating said catalyst.

2. A method as defined in claim 1 wherein said noble metal is palladium and said zeolite is Y zeolite.

3. A method as defined in claim 2 wherein said Y zeolite is a steam stabilized hydrogen Y zeolite wherein less than about 25% of its original ion exchange capacity is satisfied by metal cations.

4. A method as defined in claim 1 wherein said reducing gas comprises about 0.1 - 5 vol. % hydrogen.

5. A method as defined in claim 1 wherein at least the initial portion of said reduction in step (1) is carried out at temperatures below about 200° F.

6. A method as defined in claim 1 wherein step (2) is carried out at a pressure between about 1200 and 2500 psig and a temperature above about 300° F.

7. A method as defined in claim 6 wherein said noble metal is palladium and said zeolite is Y zeolite.

8. A method as defined in claim 7 wherein said Y zeolite is a steam stabilized hydrogen Y zeolite wherein less than about 25% of its original ion exchange capacity is satisfied by metal cations.

9. A method as defined in claim 8 wherein at least the initial portion of said reduction in step (1) is carried out at temperatures below about 200° F.

* * * * *